US007698920B2

(12) United States Patent
Yamaguchi et al.

(10) Patent No.: US 7,698,920 B2
(45) Date of Patent: Apr. 20, 2010

(54) MECHANICAL KEY AND LOCKING/UNLOCKING KEY

(75) Inventors: Jun Yamaguchi, Aichi-ken (JP); Noriyasu Shamoto, Aichi-ken (JP); Toshiharu Katagiri, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/683,369

(22) Filed: Mar. 7, 2007

(65) Prior Publication Data

US 2007/0214851 A1 Sep. 20, 2007

(30) Foreign Application Priority Data

Mar. 14, 2006 (JP) ..... 2006-068638

(51) Int. Cl.
*E05B 19/02* (2006.01)
*A45C 11/32* (2006.01)

(52) U.S. Cl. ..... 70/396; 70/397; 70/456 R

(58) Field of Classification Search ..... 70/396, 70/408, 395, 456 R, 397, 399–401, 409; 206/38.1
See application file for complete search history.

(56) References Cited

U.S. PATENT DOCUMENTS

| | | | | | |
|---|---|---|---|---|---|
| 86,114 | A * | 1/1869 | Vang | 70/396 |
| 146,536 | A * | 1/1874 | Lewis | 70/396 |
| 384,592 | A * | 6/1888 | Ross | 7/138 |
| 1,162,647 | A * | 11/1915 | Powell | 70/429 |
| 1,464,456 | A * | 8/1923 | Viehweger | 70/103 |
| 3,844,592 | A * | 10/1974 | Giardina et al. | 292/39 |
| 3,882,702 | A * | 5/1975 | Wiczer | 70/406 |
| 4,325,243 | A * | 4/1982 | Toyoda | 70/456 R |
| 4,354,368 | A * | 10/1982 | Toyoda | 70/456 R |
| 4,408,844 | A * | 10/1983 | Schoolman | 351/158 |
| 4,637,238 | A * | 1/1987 | Uda et al. | 70/456 R |
| 4,941,569 | A * | 7/1990 | Lindmayer et al. | 206/38.1 |
| 5,666,835 | A * | 9/1997 | Keller | 70/397 |
| 5,671,623 | A * | 9/1997 | Hsu | 70/375 |
| 6,035,679 | A * | 3/2000 | Meroni | 70/396 |
| 6,460,386 | B1 * | 10/2002 | Watanuki et al. | 70/456 R |
| 6,553,802 | B1 * | 4/2003 | Jacob | 70/456 R |
| 6,666,057 | B1 * | 12/2003 | Huang | 70/375 |
| 6,765,311 | B1 * | 7/2004 | Labonde | 307/10.1 |
| 7,098,791 | B2 * | 8/2006 | Okada | 340/568.1 |
| 2005/0223766 | A1 * | 10/2005 | Hashimoto et al. | 70/456 R |
| 2006/0150696 | A1 * | 7/2006 | Eychenne et al. | 70/456 R |

FOREIGN PATENT DOCUMENTS

| | | |
|---|---|---|
| JP | 2004-218371 A | 8/2004 |
| JP | 2005-290905 A | 10/2005 |

* cited by examiner

*Primary Examiner*—Peter Cuomo
*Assistant Examiner*—Alyson M Merlino
(74) *Attorney, Agent, or Firm*—Roberts Mlotkowski Safran & Cole, P.C.; Thomas W. Cole

(57) ABSTRACT

The portability of a mechanical key and a locking/unlocking key having the mechanical key is improved. The mechanical key is housed in a portable device in such a manner that a key plate is folded into two at a portion formed with an inner groove. Thus, the housing space for housing the mechanical key can be reduced and the portable device can be made smaller. Accordingly, the portability of the locking/unlocking key can be improved.

5 Claims, 11 Drawing Sheets

MECHANICAL KEY AND LOCKING/UNLOCKING KEY

CROSS-REFERENCE TO RELATED APPLICATION

This application claims priority under 35 USC 119 from Japanese Patent Application, No. 2006-68638, the disclosure of which is incorporated by reference herein.

BACKGROUND OF THE INVENTION

1. Field of the Invention

The present invention relates to a mechanical key which mechanically locks and unlocks a locking/unlocking device by inserting a key plate into a key cylinder of the locking/unlocking device for operation, and a locking/unlocking key having the mechanical key.

2. Description of the Related Art

Japanese Patent Application Laid-Open (JP-A) No. 2004-218371 describes a locking/unlocking system constructed such that when a driver carries a locking/unlocking key and approaches the door of a driver's seat, mutual communication is done between a portable device of the locking/unlocking key and a vehicle, and upon establishment of the mutual communication, a door lock as a locking/unlocking device is unlocked.

In the above locking/unlocking system, when the driver moves away from the vehicle, mutual communication between the portable device and the vehicle is unestablished so that the door is locked. The driver can lock and unlock the door without touching the vehicle. The convenience for a driver can be improved.

An emergency mechanical key is housed in the portable device of the locking/unlocking key used for this locking/unlocking system in case that mutual communication between the portable device and the vehicle cannot be done due to failure or battery exhaustion of the portable device (see Japanese Patent Application Laid-Open (JP-A) No. 2005-290905).

When the locking/unlocking operation by mutual communication of the portable device cannot be done, the driver inserts a key plate of the mechanical key into a key cylinder provided in a door for turning operation and can mechanically lock and unlock a door.

The emergency mechanical key is required to be housed in the portable device. The size (length) of the locking/unlocking key depends on the length in the longitudinal direction of the mechanical key. In this regard, the design of the portable device is limited. The locking/unlocking key is hard to be made thinner and smaller thereby, the portability thereof is not good.

A mechanical key which is singly used without being housed in the portable device is also required to be made thinner and smaller to improve the portability.

SUMMARY OF THE INVENTION

In consideration of the above facts, the present invention provides a mechanical key and a locking/unlocking key having the mechanical key which can improve the portability.

According to a first aspect of the invention, a mechanical key which has a key plate formed with a key groove, mechanically locks and unlocks a locking/unlocking device, and operated by inserting the key plate into a key cylinder of the locking/unlocking device, wherein the key plate can be folded at the portion formed with the key groove.

According to the above configuration, the locking/unlocking device is mechanically locked and unlocked by inserting the key plate formed with the key groove into the key cylinder of the locking/unlocking device.

In the above configuration, the key plate may be folded at the portion formed with the key groove. Therefore, the mechanical key can be carried in a compact shape. The portability of the mechanical key can be improved.

In the above aspect, in the portion formed with the key groove, the key plate can be folded at a position other than position in which the key cylinder reads the groove shape of the key groove.

According to the above configuration, in the portion formed with the key groove, the key plate can be folded at the position other than the position where the key cylinder reads the groove shape of the key groove. The groove shape read by the key cylinder cannot be changed. The key cylinder can precisely read the groove shape of the key groove.

In the above aspect, the key plate may have a key plate body formed with a housing part; and a pivoting plate pivotally coupled to the key plate body, the pivoting plate pivotes and folds with respect to the key plate body, and housed in the housing part of the key plate body According to the above configuration, the pivoting plate pivotally coupled to the key plate body pivots and folds with respect to the key plate body and is housed in the housing part of the key plate body When the pivoting plate folds, the pivoting plate is housed without protruding outside of the key plate body Therefore, the mechanical key can be made smaller and the portability thereof can be improved.

According to the above aspect, in the state that the key plate is unfolded, the key plate may operate by inserting into the key cylinder of the locking/unlocking device to lock and unlock the locking/unlocking device, and in the state that the key plate is folded, the key plate may operate by inserting into a key cylinder of a different locking/unlocking device to lock and unlock the different locking/unlocking device.

According to the above configuration, in the state that the key plate is unfolded, the key plate is inserted into the key cylinder of the locking/unlocking device to lock and unlock the locking/unlocking device, and in the state that the key plate is folded, the key plate is inserted into the key cylinder of the different locking/unlocking device to lock and unlock the different locking/unlocking device.

When the different locking/unlocking device is locked and unlocked, the mechanical key can be used while the key plate is folded. The key plate is not required to be unfolded. Two kinds of locking/unlocking devices can be locked and unlocked by one mechanical key. The usability of the mechanical key can be improved.

The second aspect of the invention is a locking/unlocking key includes a mechanical key of any one of the above aspects; and a portable device that houses the mechanical key and locks and unlocks the locking/unlocking device in communication with a locking/unlocking control unit that controls locking and unlocking of the locking/unlocking device.

According to the above configuration, the mechanical key can be housed in the portable device by folding the key plate of the mechanical key at the portion formed with the key groove. The housing space for housing the mechanical key can be reduced. The portable device can be made smaller. The portability of the locking/unlocking key can be improved.

The invention of the above configuration can improve the portability of the mechanical key and the locking/unlocking key having the mechanical key.

BRIEF DESCRIPTION OF THE DRAWINGS

Embodiments of the present invention will be described in detail based on the following figures, wherein.

DETAILED DESCRIPTION OF THE INVENTION

An example of exemplary embodiments of a locking/unlocking key of the present invention will be described based on the drawings.

First Exemplary Embodiment

Figure 1:
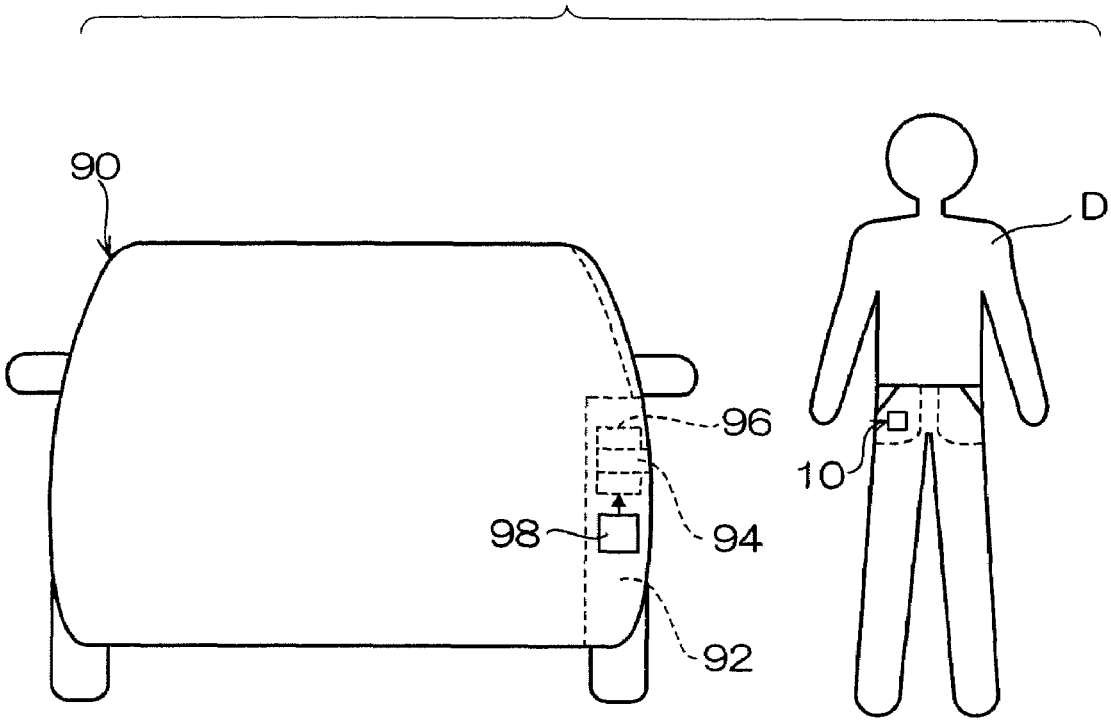
FIG. 1 is a schematic view showing the function of a locking/unlocking key of a first exemplary embodiment of the invention.

As shown in FIG. 1, a vehicle key 10 as a locking/unlocking key locks and unlocks a locking/unlocking device provided in a vehicle 90, e.g., a door lock 96 provided in a door 92 of the vehicle 90. The door lock 96 is provided with a key cylinder 94, and a locking/unlocking control unit 98 controlling locking and unlocking of the door lock 96.

Figure 2:
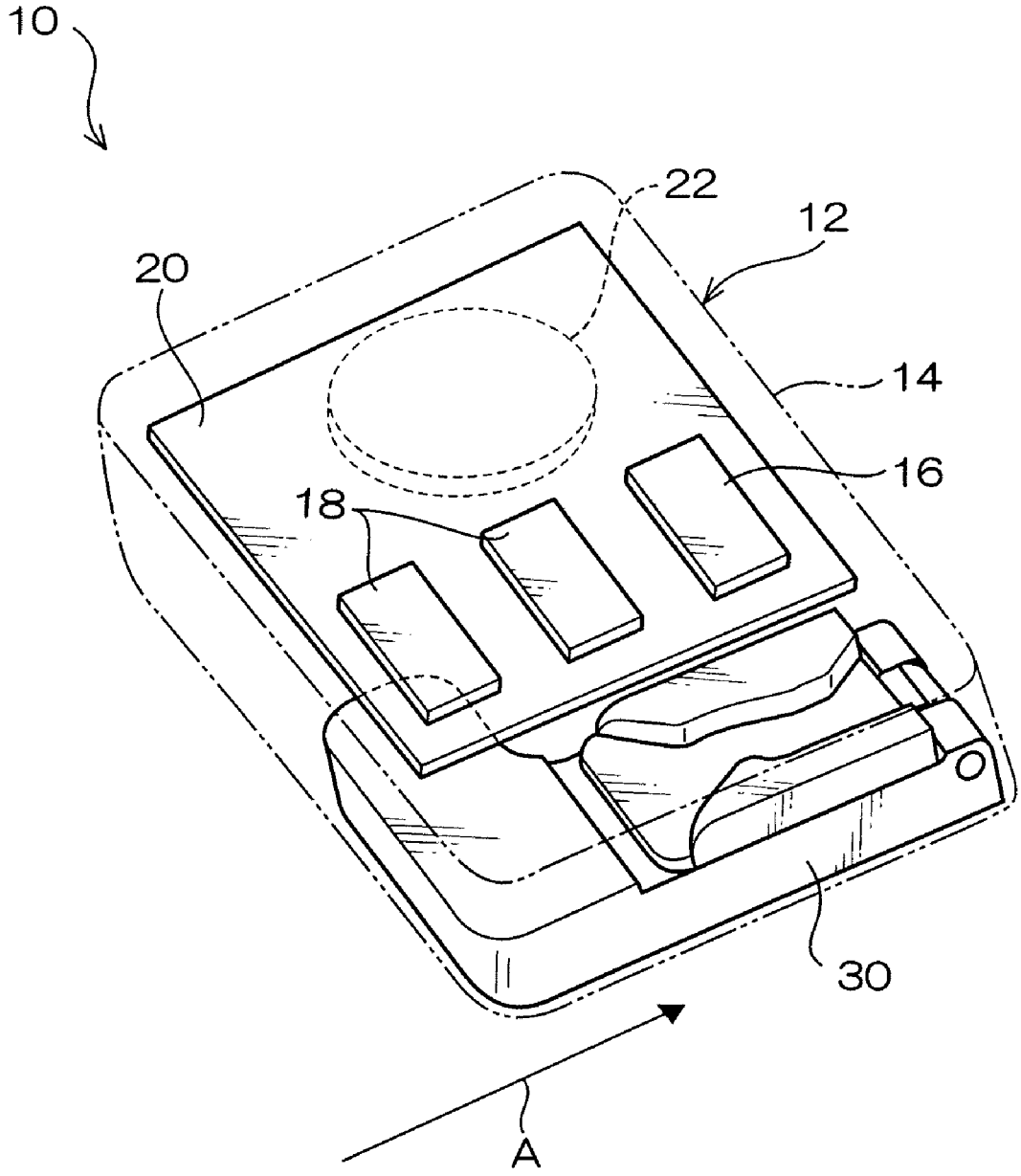
FIG. 2 is a perspective view showing a vehicle key of the first exemplary embodiment.
Figure 3:
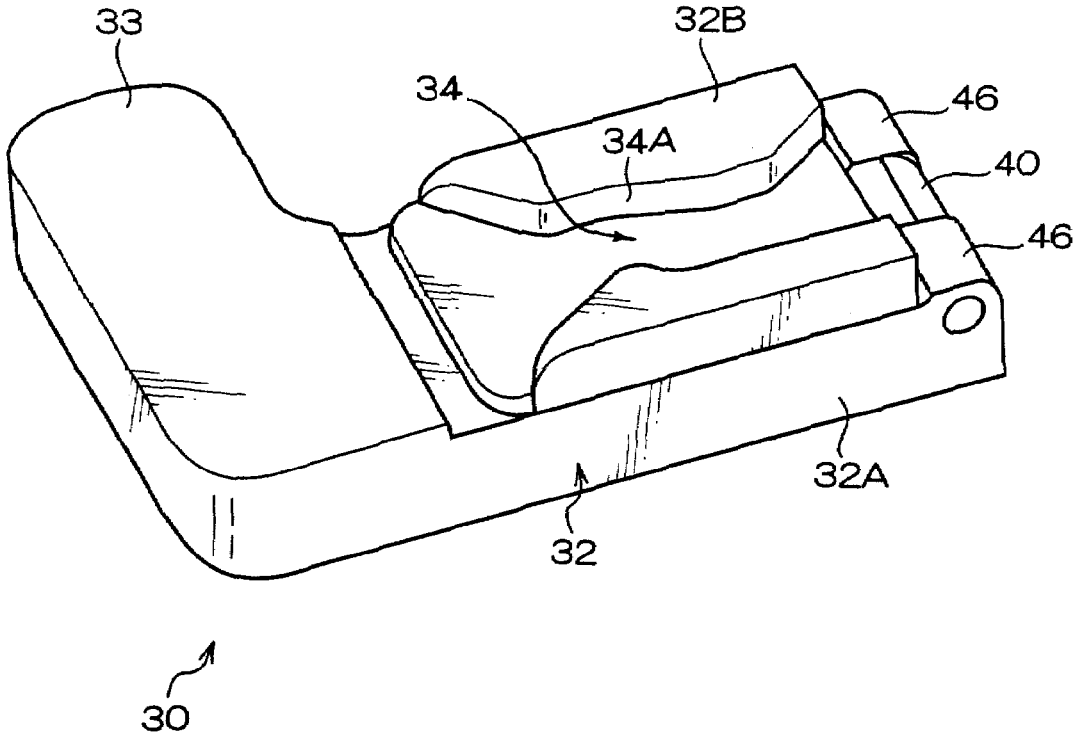
FIG. 3 is a perspective view of a mechanical key of the first exemplary embodiment showing the state that a key plate is folded.

As shown in FIG. 2, the vehicle key 10 has a portable device 12 locking and unlocking the door lock 96 in communication with the locking/unlocking control unit 98 provided in the door lock 96. The portable device 12 has a housing 14 in a substantially rectangular parallelepiped shape formed of a synthetic resin. The housing 14 has in its inside a printed wiring board 20 on which a communication module 16 and other electronic components 18 are mounted.

A battery 22 is housed in the back surface side (the surface side on which the electronic components are not mounted) of the printed wiring board 20. The battery 22 is electrically connected to the power terminals of the printed wiring board 20 and supplies power to the communication module 16 and the electronic components 18.

When a request signal requiring transmission of an ID code is transmitted from the locking/unlocking control unit 98 provided in the door lock 96, the communication module 16 receives the request signal and transmits an ID code recorded in advance.

When a driver (user) D carries the vehicle key 10 and approaches the vehicle 90, mutual communication is done between the portable device 12 and the locking/unlocking control unit 98. When the mutual communication is established, that is, the ID code transmitted from the portable device 12 is matched with an ID code recorded in advance, the locking/unlocking control unit 98 unlocks the door lock 96 of the vehicle 90.

When the driver D carries the vehicle key 10 and moves away from the vehicle 90, mutual communication between the portable device 12 and the locking/unlocking control unit 98 is unestablished. The locking/unlocking control unit 98 locks the door lock 96 of the vehicle 90. The driver D carrying the vehicle key 10 can lock and unlock the door lock 96 without touching the vehicle 90.

As shown in FIG. 2, a mechanical key 30 is housed in the housing 14. The mechanical key 30 is provided for emergency in case that mutual communication between the portable device 12 and the vehicle 90 cannot be done due to failure or battery exhaustion of the portable device 12. The mechanical key 30 is inserted into and housed in the housing 14 in a lateral direction A of the housing 14. Note that even if the portable device 12 can mutually communicate with the vehicle 90, the mechanical key 30 can be used.

As shown in FIGS. 3 to 6, the mechanical key 30 has a metallic key plate 32 inserted into the key cylinder 94 provided in the door lock 96, and a grasping part 33 formed in L shape together with the key plate 32. The key plate 32 and the grasping part 33 are integrally formed by the same metallic material.

Figure 5:
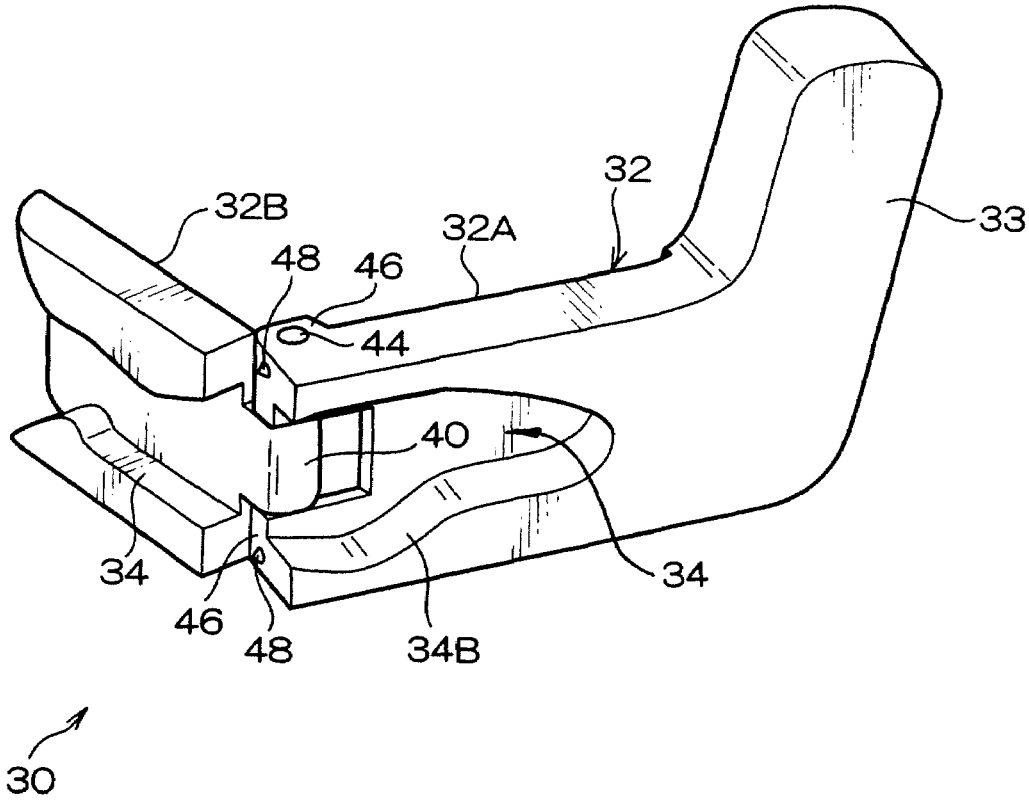
FIG. 5 is a perspective view of the mechanical key of the first exemplary embodiment showing the state that the key plate is being unfolded.
Figure 6:
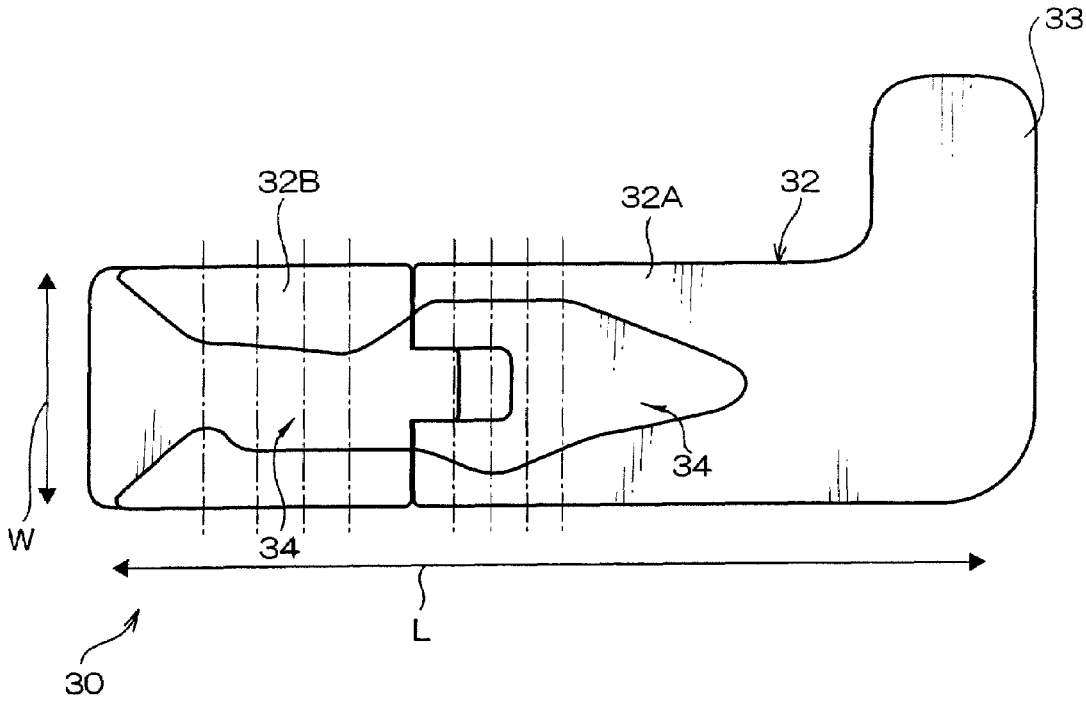
FIG. 6 is a plan view of the mechanical key of the first exemplary embodiment showing the state that the key plate is unfolded.
Figure 7:
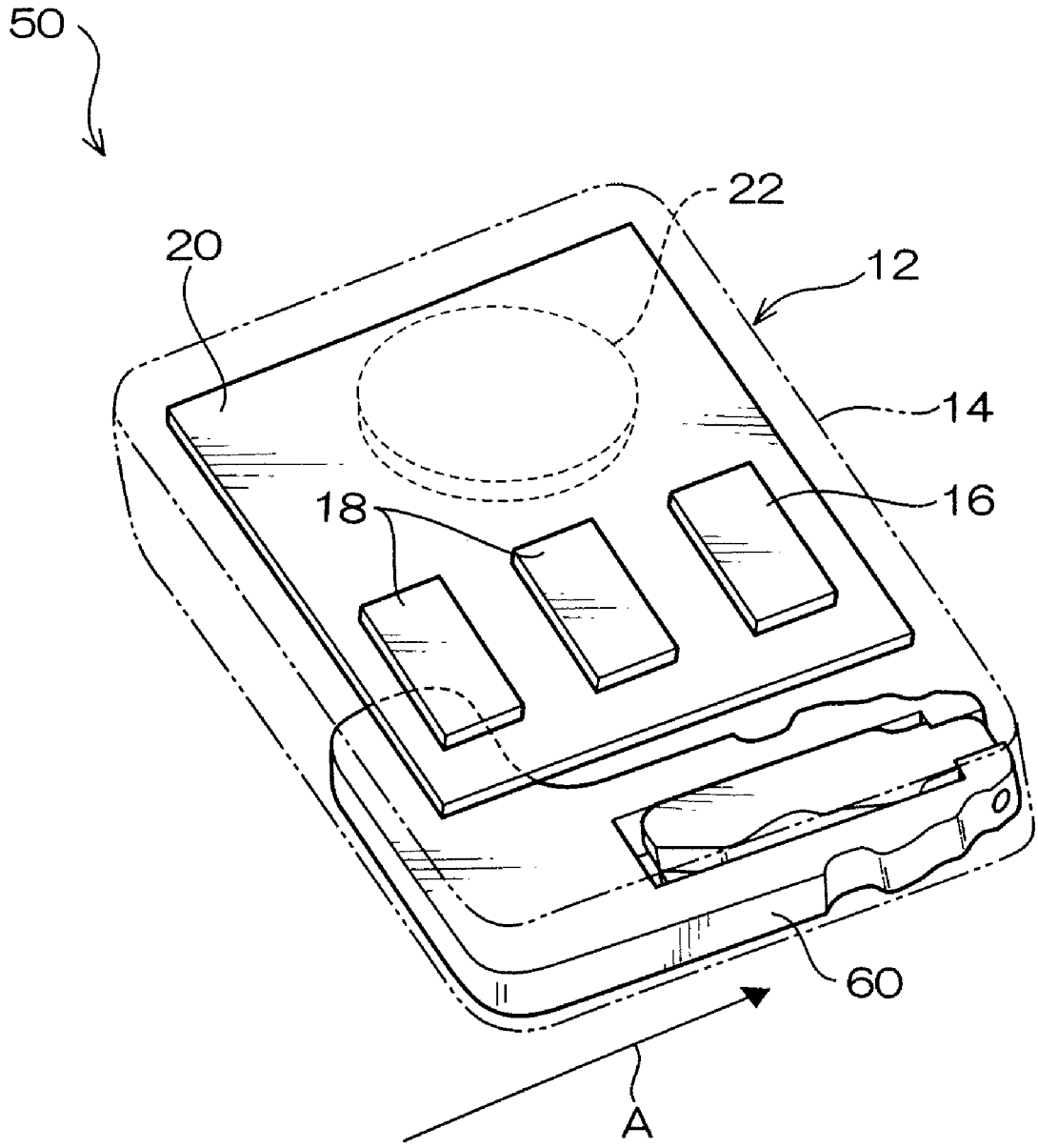
FIG. 7 is a perspective view showing a vehicle key of a second exemplary embodiment.

As shown in FIGS. 5 and 6, the front surface (one surface) of the key plate 32 is formed with an coded inner groove (key groove) 34 (i.e., bitting) from the front end toward the rear end of the key plate 32. The groove width of the inner groove 34 in a width direction W of the key plate 32 varies along a longitudinal direction L of the key plate 32. The groove shape of the inner groove 34 is unique corresponding to the unique key number of the key cylinder 94. The inner groove 34 comprises a first curved groove wall 34A and a second curved groove wall 34B; the shape of the groove wall 34A is independent from the groove wall 34B as seen in FIGS. 5 and 6. The groove wall 34A and the groove wall 34B are not parallel as seen in FIGS. 5 and 6.

Upon insertion of the key plate 32, the key cylinder 94 contacts a pin(s) or the like with the inside of the inner groove 34 to mechanically read plural groove widths of the inner groove 34 in the width direction W of the key plate 32. The key cylinder 94 reads the groove shapes of the inner groove 34 and checks whether or not the groove shapes of the inner groove 34 matches with the key number unique to the key cylinder 94. When the groove shape of the inner groove 34 matches with the key number unique to the key cylinder 94, it is made possible for the grasping part 33 to be turnably operated to lock or unlock the door lock 96. FIG. 6 indicates with alternate long and short dash lines an example of the position in which the key cylinder 94 reads the groove shape of the inner groove 34 (groove widths of the inner groove 34).

As shown in FIGS. 3 to 6, the key plate 32 is divided into two, a key plate body (the rear end side of the key plate) 32A and a pivoting plate (the front end of the key plate) 32B at the center part in the longitudinal direction of the inner groove 34. The key plate body 32A and the pivoting plate 32B are divided at a position other than position (for instance, the position indicated by the alternate long and short dash lines shown in FIG. 6) in which the key cylinder 94 reads the groove shape of the inner groove 34 (the groove widths of the inner groove 34).

Figure 4:
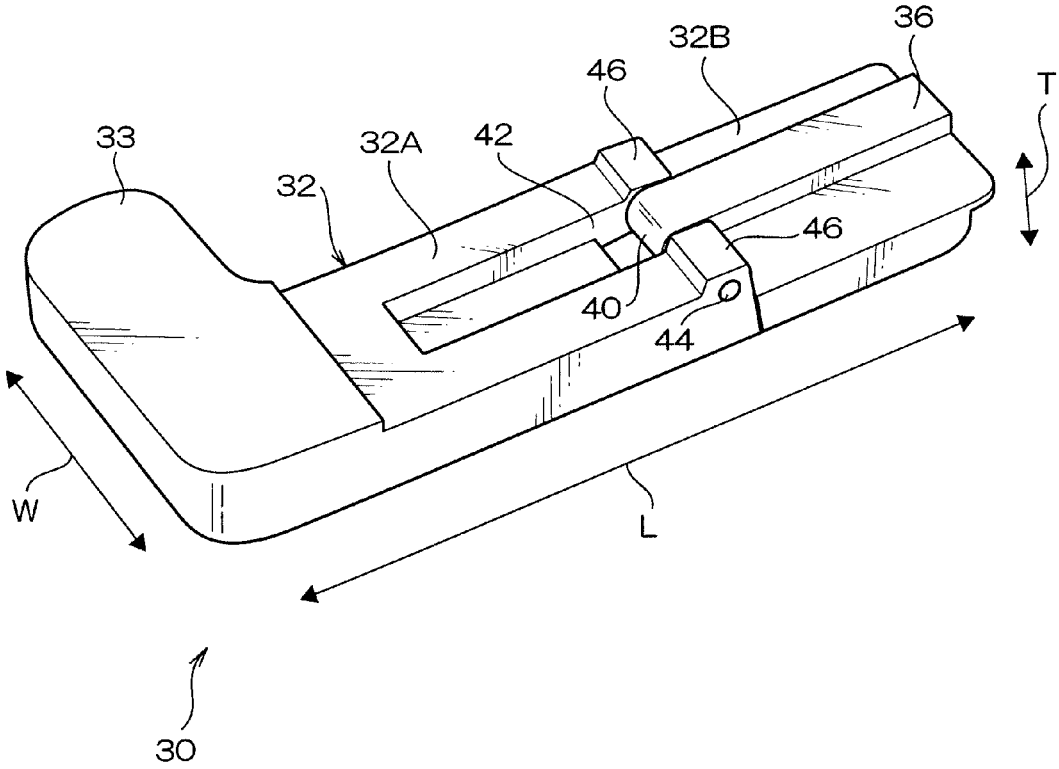
FIG. 4 is a perspective view of the mechanical key of the first exemplary embodiment showing the state that the key plate is unfolded.

As shown in FIG. 4, the back surface (the surface not formed with the inner groove 34) of the pivoting plate 32B is formed with a convex portion 36 extended in the longitudinal direction L of the key plate 32 at the center part in the width direction W of the key plate 32.

One end in the longitudinal direction of the convex portion 36 is protruded toward the key plate body 32A side. The protruded portion is a bearing part 40 formed with an axial hole in the width direction W of the key plate 32.

The center part at the front end of the key plate body 32A is formed with an insertion groove 42 into which the bearing part 40 as well as the convex portion 36 of the pivoting plate 32B can be inserted. The center part at the front end of the key plate body 32A is also formed with a pair of bearing parts 46 formed with axial holes in the width direction W of the key plate 32 so as to interpose the bearing part 40 therebetween. Portions of the pair of bearing parts 46 are protruded through the back surface side of the key plate 32 in a thickness direction T of the key plate 32.

A support shaft 44 is inserted into the axial holes of the bearing parts 40, 46. The pivoting plate 32B can pivot around the shaft 44 extending in the width direction W of the key plate 32.

The pivoting plate 32B is pivoted in the range of about 180 degrees between the folded position folded with respect to the key plate body 32A so as to be overlapped with the back surface side of the key plate body 32A and the unfolded position unfolded with respect to the key plate body 32A.

In the folded position of the pivoting plate 32B, the key plate 32 is folded at the position other than the position where the groove shape of the inner groove 34 (the groove widths of the inner groove 34) are read. The convex portion 36 formed on the back surface of the pivoting plate 32B is fitted in the insertion groove 42 formed on the back surface side of the key plate body 32A. In the state that the key plate 32 is folded (see FIG. 3), the mechanical key 30 can be housed in the portable device 12.

The pivoting plate 32B is pivoted to the unfolded position and the key plate 32 is unfolded. In the state that the key plate 32 is unfolded (see FIGS. 4 and 6), the key plate 32 is inserted into the key cylinder 94 to lock and unlock the door lock 96.

As shown in FIG. 5, protrusions (holding parts) 48 are provided on the outer periphery surfaces of the pair of bearing parts 46 while opposing the pivoting plate 32B. The pivoting plate 32B passes over the protrusions 48 to pivot to the unfolded position. When the pivoting plate 32B is in the unfolded position, ends of the pivoting plate 32B are brought into contact with the protrusions 48 to hold the unfolded state of the key plate 32.

In place of the configuration, the hole diameters of the axial holes of the bearing parts 40, 46 may be formed to be smaller to enhance the friction force between the bearing parts 40, 46 and the support shaft 44 for holding the unfolded state of the key plate 32.

The operation of the above exemplary embodiment will be described.

When the driver D carries the vehicle key 10 and approaches the vehicle 90, mutual communication between the portable device 12 and the door lock 96 is established. The door lock 96 of the vehicle 90 is unlocked so that the driver D can get into the vehicle 90 (see FIG. 1.).

If mutual connection between the portable device 12 and the door lock 96 cannot be done due to battery exhaustion or failure of the portable device 12, although the driver D carries the vehicle key 10 and approaches the vehicle, the door lock 96 cannot be unlocked. In this case, the driver D need to use the mechanical key 30 housed in the portable device 12 to unlock the door.

The mechanical key 30 folded and housed in the portable device 12 is taken out from the portable device 12. The pivoting plate 32B of the mechanical key 30 is pivoted from the folded position to the unfolded position. The pivoting plate 32B is unfolded with respect to the key plate body 32A.

The key plate 32 of the mechanical key 30 is inserted into the key cylinder 94 for turning operation to unlock the door lock 96. The driver D can get into the vehicle 90.

After the door lock 96 is unlocked, the pivoting plate 32B is pivoted from the unfolded position to the folded position to fold the key plate 32. The pivoting plate 32B is overlapped with the key plate body 32A so that the mechanical key 30 is housed in the portable device 12.

In this exemplary embodiment, the mechanical key 30 is housed in the portable device 12 in such a manner that the key plate 32 is folded into two at the position formed with the inner groove 34. Therefore, the housing space for housing the mechanical key 30 can be reduced. Accordingly, the portable device 12 can be made smaller and the portability of the vehicle key 10 can be improved.

As shown in FIG. 2, the mechanical key 30 is inserted and housed in the lateral direction A of the housing 14 of the portable device 12. Since the vehicle key 10 is not large, the insertion direction and the housed position of the mechanical key 30 can be designated freely.

Since the size (length) of the portable device 12 does not depend on the entire length in the longitudinal direction of the mechanical key 30, the portable device 12 can be designed considerably discretionary. Further, when other functions are added to the portable device 12, the portable device 12 can be prevented from being larger.

The key plate 32 is folded at the center part in the longitudinal direction of the inner groove 34. The length in the longitudinal direction of the mechanical key 30 can be reduced. The mechanical key 30 can be made smaller.

The key plate 32 is folded at the portion formed with the inner groove 34. In this exemplary embodiment, the key plate 32 is folded at the position other than the position where the key cylinder 94 reads the groove shape of the inner groove 34 (the groove widths of the inner groove 34). Therefore, the groove shape of the inner groove 34 (the groove widths of the inner groove 34) in the position read by the key cylinder 94 are not changed. The key cylinder 94 can precisely read the groove shape of the inner groove 34 (the groove widths of the inner groove 34).

Second Exemplary Embodiment

A second exemplary embodiment of the invention will be described. The same parts as those of the first exemplary embodiment are indicated by like reference numerals and the description is omitted.

A vehicle key 50 as a locking/unlocking key of the second exemplary embodiment has a mechanical key 60 housed in the housing 14 of the portable device 12. The mechanical key 60 is inserted into and housed in the housing 14 in the lateral direction A of the housing 14.

Figure 8:
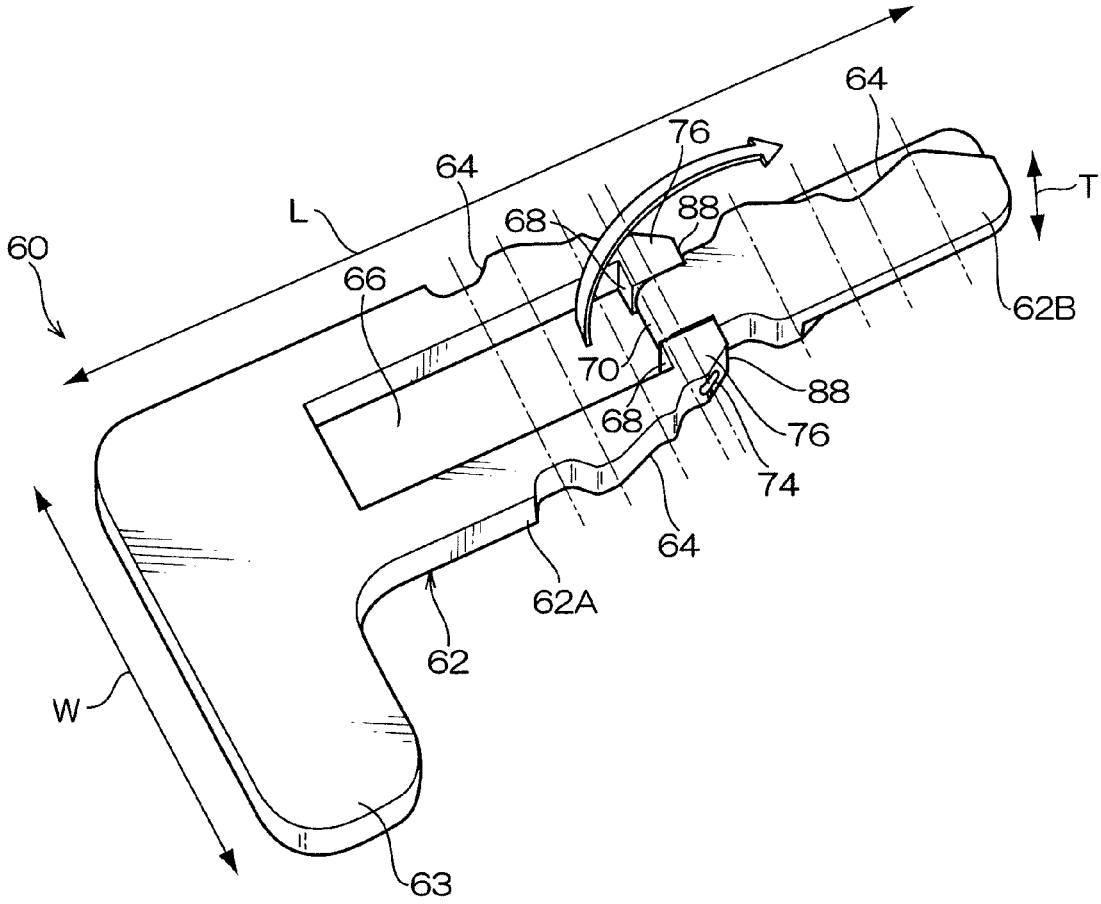
FIG. 8 is a perspective view of a mechanical key of the second exemplary embodiment showing the state that a key plate is unfolded.
Figure 9:
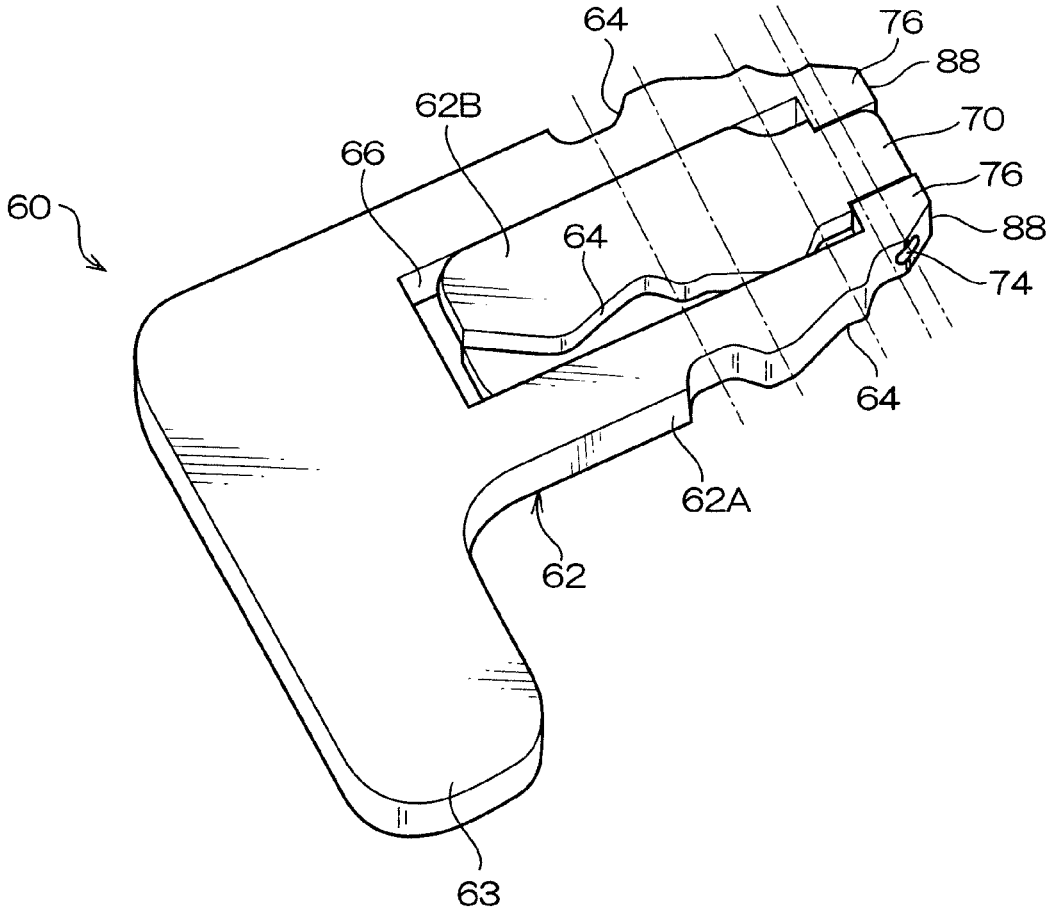
FIG. 9 is a perspective view of the mechanical key of the second exemplary embodiment showing the state that the key plate is folded.

As shown in FIGS. 8 to 9, the mechanical key 60 has a metallic key plate 62 inserted into the key cylinder 94 provided in the door lock 96, and a grasping part 63 formed in L shape together with the key plate 62. The key plate 62 and the grasping part 63 are integrally formed of the same metallic material.

As shown in FIGS. 8 and 9, the side surface of the key plate 62 is formed with outer groove (key groove) 64 from the front end toward the rear end of the key plate 62. The groove depths of the outer groove 64 in the width direction W of the key plate 62 are vary in the longitudinal direction L of the key plate 62. The groove shape of the outer groove 64 is unique corresponding to the unique key number of the key cylinder 94.

Upon insertion of the key plate 62, the key cylinder 94 contacts a pin or the like with the outer groove 64 to mechanically read plural groove depths of the outer groove 64 in the width direction W of the key plate 62. The key cylinder 94 reads the groove shape of the outer groove 64 to check whether or not the groove shape of the outer groove 64 are matched with the key number unique to the key cylinder 94. When the groove shape of the outer groove 64 is matched with the key number unique to the key cylinder 94, the grasping part 63 is turnably operated to lock and unlock the door lock 96. FIGS. 8 and 9 indicates with the alternate long and short dash lines an example of the position in which the key cylinder 94 reads the groove shape of the outer groove 64 (the groove depths of the outer groove 64).

As shown in FIGS. 8 and 9, the key plate 62 is divided into two, a key plate body (the rear end side of the key plate) 62A and a pivoting plate (the front end of the key plate) 62B in the center part in the longitudinal direction of the outer groove 64. The key plate body 62A and the pivoting plate 62B are divided at a position other than position (the portions indicated by the alternate long and short dash lines shown in FIGS. 8 and 9) where the key cylinder 94 reads the groove shape of the outer groove 64 (the groove depths of the outer groove 64).

Figure 10:
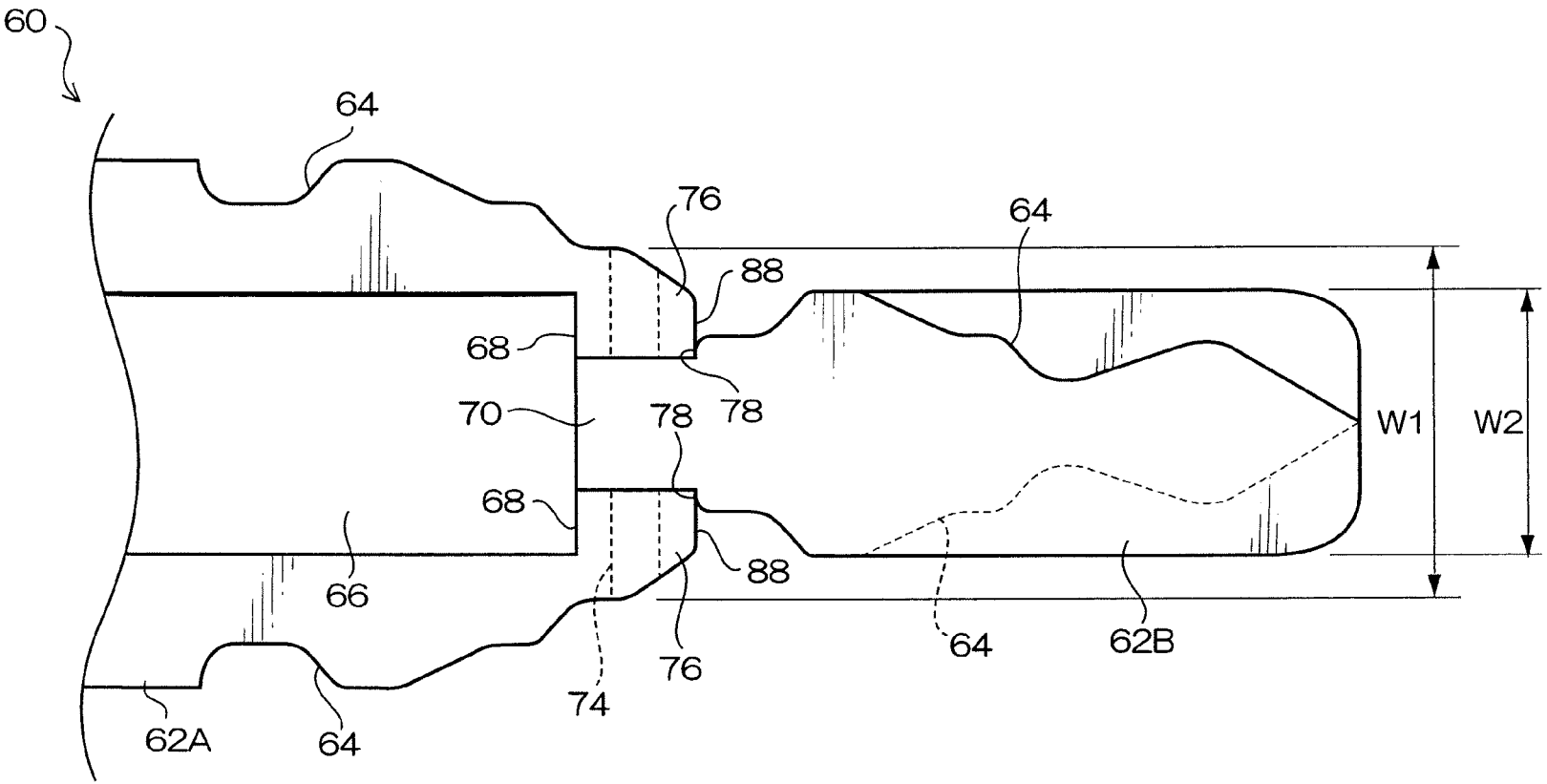
FIG. 10 is a plan view of the mechanical key of the second exemplary embodiment showing the front end of the key plate in the state that the key plate is unfolded.

The key plate body 62A and the pivoting plate 62B have the same wall thickness. As shown in FIG. 10, the largest width W2 of the pivoting plate 62B is smaller than the smallest width W1 of the portion formed with the outer groove 64 in the key plate body 62A.

An opening 66 as the housing part housing the pivoting plate 62B is formed in the center part of the key plate body 62A. The opening 66 has the substantially same lateral width as the pivoting plate 62B and is rectangular. The housing part is not limited to the opening and may be a groove part not passing through the key plate body 62A.

The pivoting plate 62B is formed with a bearing part 70 protruded toward the key plate body 62A side and formed with an axial hole in the width direction W of the key plate 62.

The front end of the key plate body 62A is formed with a pair of bearing parts 76 formed with axial holes in the width direction W of the key plate 62 so as to interpose the bearing part 70 therebetween.

A support shaft 74 is inserted into the axial holes of the bearing parts 70, 76 to couple the key plate body 62A to the pivoting plate 62B. The axial direction of the support shaft 74 is in the width direction W of the key plate 62 and the pivoting plate 62B can be pivoted around the support shaft 74.

In the first exemplary embodiment, the bearing parts 46 are protruded to the back surface side of the key plate 32 and the pivoting axis of the pivoting plate 32B is in the position displaced from the center part in the thickness direction T of the key plate 32. In the second exemplary embodiment, the bearing parts 70, 76 are provided in the center part in the thickness direction T of the key plate 62. The pivoting axis of the pivoting plate 62B is accordingly arranged in the center part in the thickness direction T of the key plate 62.

The pivoting plate 62B is pivoted in the range of about 180 degrees between the housed position folded with respect to the key plate body 62A and housed in the opening 66 of the key plate body 62A and the unfolded position unfolded with respect to the key plate body 62A.

In the state that the pivoting plate 62B is in the housed position (see FIG. 9), the key plate 62 is folded at the position other than the position where the groove shape of the outer groove 64 (the groove depths of the outer groove 64) are read. Contacted surfaces 78 at the coupled ends of the pivoting plate 62B are brought into contact with inner wall surfaces 68 of the opening 66 of the key plate body 62A (see FIG. 10) to regulate pivoting of the pivoting plate 62B. In the state that the key plate 62 is folded (see FIG. 9), the mechanical key 60 can be housed in the portable device 12.

Figure 11:
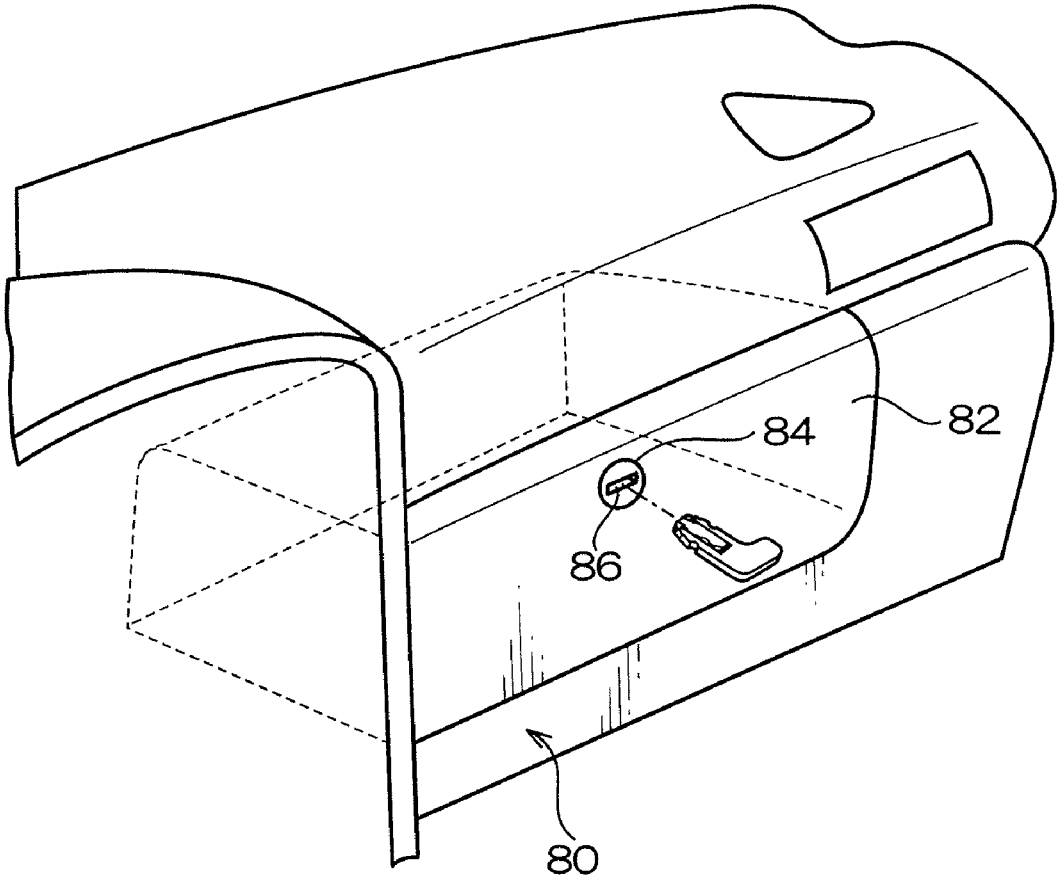
FIG. 11 is a perspective view of the mechanical key of the second exemplary embodiment showing the state that a door lock of a glove box is locked and unlocked.

As shown in FIG. 11, in the state that the key plate 62 is folded, the key plate 62 is inserted into a key cylinder 86 of a door lock 84 as the locking/unlocking device provided in a door 82 of a glove box 80. The door lock 84 of the glove box 80 can be locked and unlocked. The key cylinder 94 reads the groove shape of the outer groove 64 (the groove depths of the outer groove 64) in the position indicated with the alternate long and short dash lines shown in FIG. 9 (four portions).

The pivoting plate 62B is pivoted to the unfolded position to extend the key plate 62. In the state that the key plate 62 is unfolded (see FIG. 8), the contacted surfaces 78 at the coupled ends of the pivoting plate 62B are brought into contact with outer wall surfaces 88 of the key plate body 62A (see FIG. 10) so that pivoting of the pivoting plate 62B is regulated to hold the unfolded state of the key plate 62.

In the state that the key plate 62 is unfolded, the key plate 62 is inserted into the key cylinder 94 to lock and unlock the door lock 96. The key cylinder 94 reads the grove shape of the outer groove 64 (the groove depths of the outer groove 64) in the portions indicated with the alternate long and short dash lines shown in FIG. 8 (eight portions).

In the state that the key plate 62 is unfolded, the key plate 62 is inserted into the key cylinder (not shown) of the door lock of the trunk provided in the vehicle 90 for turning operation. The door lock of the trunk can be locked and unlocked.

The operation of the above exemplary embodiment will be described.

When the driver D carries the vehicle key 50 and approaches the vehicle 90, mutual communication between the portable device 12 and the door lock 96 is established. The door lock 96 is unlocked so that the driver D can get into the vehicle 90 (see FIG. 1.).

When mutual connection between the portable device 12 and the door lock 96 cannot be done due to battery exhaustion or failure of the portable device 12, although the driver D carries the vehicle key 50 and approaches the vehicle, the door lock 96 cannot be unlocked. In this case, the driver D needs to use the mechanical key 60 housed in the portable device 12 to unlock the door lock 96.

The mechanical key 60 folded and housed in the portable device 12 is taken out from the portable device 12. The pivoting plate 62B of the mechanical key 60 is pivoted from the folded position to the unfolded position. The pivoting plate 62B is unfolded with respect to the key plate body 62A.

The key plate 62 of the mechanical key 60 is inserted into the key cylinder 94 for turning operation to unlock the door lock 96. The driver D can get into the vehicle 90. In the state that the key plate 62 is unfolded, the key plate 62 can also be inserted into the key cylinder (not shown) of the door lock of the trunk provided in the vehicle 90 for turning operation. The door lock of the trunk can be locked and unlocked.

After the door lock 96 is unlocked, the pivoting plate 32B is pivoted from the unfolded position to the housed position to fold the key plate 62. The pivoting plate 62B is housed in the opening 66 of the key plate body 62A so as to house the mechanical key 60 in the portable device 12.

In the state that the key plate 62 is folded, the key plate 62 is inserted into the key cylinder 86 of the door lock 84 provided in the door 82 of the glove box 80. The door 82 of the glove box 80 can be locked and unlocked.

In this exemplary embodiment, the mechanical key 60 is housed in the portable device 12 in such a manner that the key plate 62 is folded into two at the position formed with the outer groove 64. Therefore, the housing space for housing the mechanical key 60 can be reduced and the portable device 12 can be made smaller. Thus, the portability of the vehicle key 50 can be improved.

As shown in FIG. 2, the mechanical key 30 is inserted and housed in the lateral direction A of the housing 14 of the portable device 12. Since the vehicle key 10 is not large, the insertion direction and the housed position of the mechanical key 30 can be designated freely.

Since the size (length) of the portable device 12 does not depend on the length in the longitudinal direction of the mechanical key 30, the portable device 12 can be designed considerably discretionary. Additionally, when other functions are added to the portable device 12, the portable device 12 can be prevented from becoming larger.

The key plate 62 is folded at the center part in the longitudinal direction of the outer groove 64. The length in the longitudinal direction of the mechanical key 60 can be reduced and the mechanical key 60 can be made smaller.

The pivoting plate 62B is pivoted and folded with respect to the key plate body 62A and is housed in the housing part of the key plate body 62B. That is, when the pivoting plate 62B is folded, the pivoting plate 62B does not protrude and the mechanical key 60 can be made smaller.

The key plate body 62A and the pivoting plate 62B have the same wall thickness. The pivoting axis of the pivoting plate 62B is arranged in the center part in the thickness direction T of the key plate 62. According to these arrangements, the thickness of the key plate 62 in the folded state does not become increased and the mechanical key 60 can be made smaller.

The key plate 62 is folded at the portion formed with the outer groove 64. In this exemplary embodiment, the key plate 62 is folded at the position other than the position where the key cylinder 94 reads the groove shape of the outer groove 64 (the groove depths of the outer groove 64). The groove shape of the outer groove 64 (the groove depths of the outer groove 64) at the position read by the key cylinder 94 cannot be changed. The key cylinder 94 can precisely read the groove shape of the outer groove 64 (the groove depths of the outer groove 64).

In the state that the key plate 62 is folded, the door lock 84 provided in the door 82 of the glove box 80 can be locked and unlocked. When the door 82 of the glove box 80 is opened and closed, the key plate 62 is not required to be unfolded.

In the state that the key plate 62 is folded, the number of the groove shape of the outer groove 64 (the groove depths of the outer groove 64) read by the key cylinder 94 can be reduced. The configuration of the door lock 84 can be simplified. Since two kinds of locking/unlocking devices can be locked and unlocked by one mechanical key 60, the mechanical key 60 becomes quite utilizable.

In the door 82 of the glove box 80, the length of the key cylinder 86 of the door lock 84 (the length in the direction which the key plate 62 is inserted) needs to be short due to reasons of the box 80 configuration and usable space. If the key plate 62 in the unfolded state is inserted into the key cylinder 86 of the door lock 84 to turn the mechanical key 60, a load is applied to the bearing parts 76 and 70 formed in the key plate 62 and the support shaft 74 (the center of pivoting) inserted into the axial holes of the bearing parts 76 and 70, which may cause a problem. In this exemplary embodiment, as the key plate 62 in the folded state is inserted into the key cylinder 86 and the mechanical key 60 is turned, no load is applied to the bearing parts 76 and 70 as well as the support shaft 74 (the center of pivoting) inserted into the axial holes of the bearing parts 76 and 70, thus a problem is not generated at these portions.

In the second exemplary embodiment, in the state that the key plate 62 is folded, the door lock 84 of the glove box 80 can be locked and unlocked, and in the state that the key plate 62 is unfolded, the door lock 96 and the door lock of the trunk provided in the vehicle 90 can be locked and unlocked. However, in the state that the key plate 62 is folded, the door lock of the trunk provided in the vehicle 90 may be locked and unlocked, and in the state that the key plate 62 is unfolded, the door lock 84 of the glove box 80 may be locked and unlocked. The locking/unlocking device which can be locked and unlocked in the state that the key plate 62 is folded and a different locking/unlocking device which can be locked and unlocked in the state that the key plate 62 is unfolded can be optionally set.

In the first and second exemplary embodiments, the vehicle key is described above as an example of the locking/unlocking key of the invention. The locking/unlocking key of the invention is not limited to this and may be a house key locking and unlocking the door of a house. Any locking/unlocking key which locks and unlocks the locking/unlocking device may be used.

When the locking/unlocking key of the invention is applied to a house key, a mailbox or a delivery box may be locked and unlocked in the state that the mechanical key of the house key is folded and the door of a house may be locked and unlocked in the state that the mechanical key of the house key is unfolded.

In the first and second exemplary embodiments, the mechanical key housed in the portable device is described above. The mechanical key of the invention is not limited to this and may be singly used without being housed in the portable device.

In the first and second exemplary embodiments, the portable device is substantially rectangular. The shape of the portable device is not limited to this and may be of other shape. The inner construction of the portable device and the position for housing the mechanical key in the portable device can be optionally changed.

The invention is not limited to the above exemplary embodiments and various modifications, changes and improvements can be made without departing from the scope of the invention.

What is claimed is:

1. A mechanical key comprising a key plate formed with a coded key groove that mechanically locks and unlocks a locking device, and which is operated by inserting the key plate into a single key cylinder of the locking device such that the length of the key groove is inserted inside said single cylinder, wherein the key plate comprises a key plate body; and a pivoting plate pivotally coupled to the key plate body, the pivoting plate being capable of pivoting at a pivot joint and folding 180° with respect to the key plate body such that the key plate body and the pivoting plate are capable of overlapping to a folded position, wherein the key groove is provided on the key plate so as to extend across the key plate body the pivot joint, and the pivoting plate, in a lengthwise direction, the width of the key groove in a width direction of the key plate body and the pivoting plate varying along said lengthwise direction of the key plate such that the varying widths of the key groove are configured to be read by the single key cylinder of the locking device.

2. The mechanical key of claim 1, wherein the pivot joint being located about midway along the length of the key groove, and wherein the single key cylinder reads portions of the shape of the key groove along said length of said key groove that is insertable inside said single cylinder other than at the pivot join.

3. A key assembly for a vehicle locking device having a single key cylinder, comprising a mechanical key having a key plate comprising a key plate body and a pivoting plate pivotally coupled to the key plate body, the pivoting plate being capable of pivoting and folding 180° at a pivot joint with respect to the key plate body such that the key plate body and the pivoting plate are capable of overlapping to a folded position, both the key plate body and the pivoting plate having a coded key groove that mechanically locks and unlocks said single key cylinder of said vehicle locking device, the mechanical key being operated by inserting the key plate body and the pivoting plate into said single key cylinder of the locking device such that the length of the key groove is inserted inside said single cylinder, wherein the key groove is provided so as to extend across the key plate body, the pivot joint, and the pivoting plate, the key groove is formed within the key plate body and the pivoting plate, the width of the key groove in a width direction of the key plate body and the pivoting plate varying along lengthwise direction of the key plate and being configured to be read by said single key cylinder of the locking device, and a portable electronic key having a housing including a recess that receives the mechanical key in a folded position and locks and unlocks the vehicle locking device by communicating with a locking control unit that electronically controls locking and unlocking of the vehicle locking device.

4. The key assembly for a vehicle of claim 3, wherein the pivot joint being located about midway along the length of the mechanical key, and wherein the single key cylinder reads portions of the key groove other than at the pivot join.

5. The key assembly for a vehicle of claim 3, wherein the key plate body is formed with a recess for receiving said pivoting plate; such that a thickness of said key plate body and pivoting plate, when overlapped in the folded position, is less than the combined thickness of said key plate body and the pivoting plate.

* * * * *